US007637323B2

(12) United States Patent
Schasteen et al.

(10) Patent No.: US 7,637,323 B2
(45) Date of Patent: Dec. 29, 2009

(54) BALL SEAT HAVING FLUID ACTIVATED BALL SUPPORT

(75) Inventors: Thomas Schasteen, The Woodlands, TX (US); James G King, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 178 days.

(21) Appl. No.: 11/891,715

(22) Filed: Aug. 13, 2007

(65) Prior Publication Data

US 2009/0044946 A1 Feb. 19, 2009

(51) Int. Cl.
*E21B 34/08* (2006.01)

(52) U.S. Cl. ..... 166/318; 166/386; 137/516.25; 137/516.27

(58) Field of Classification Search ..... 166/318, 166/193, 326, 386; 137/516.27, 516.25, 137/519.5, 516
See application file for complete search history.

(56) References Cited

U.S. PATENT DOCUMENTS

| | | | | |
|---|---|---|---|---|
| 1,883,071 | A | 10/1932 | Stone | |
| 2,769,454 | A | 11/1956 | Bletcher et al. | |
| 2,822,757 | A | 2/1958 | Coberly | |
| 2,973,006 | A | 2/1961 | Nelson | |
| 3,007,527 | A | 11/1961 | Nelson | |
| 3,013,612 | A * | 12/1961 | Angel | 166/325 |
| 3,211,232 | A | 10/1965 | Grimmer | |
| 3,510,103 | A | 5/1970 | Carsello | |
| 3,566,964 | A | 3/1971 | Livingston | |
| 3,667,505 | A | 6/1972 | Radig | |
| 3,727,635 | A | 4/1973 | Todd | |

(Continued)

FOREIGN PATENT DOCUMENTS

| | | |
|---|---|---|
| GB | 2281924 A | 3/1995 |
| WO | WO 00/15943 | 3/2000 |

OTHER PUBLICATIONS

Notification of Transmittal of the International Search Report and the Written Opinion of the International Searching Authority, Or the Declaration, Jan. 19, 2009, pp. 1-4, PCT/US2008/072470, Korean Intellectual Property Office.

(Continued)

*Primary Examiner*—Giovanna C Wright
(74) *Attorney, Agent, or Firm*—Greenberg Traurig LLP; Anthony F. Matheny

(57) ABSTRACT

Apparatuses for closing a well conduit comprise a housing having a longitudinal bore and a seat disposed within the bore. A chamber is disposed within the housing and includes a plug element support member, such as ram or piston, operatively associated within the chamber. The plug element support member has a retracted position and an extended position. A passageway is in fluid communication with the bore and the chamber. A plug element such as a ball or drop plug, is adapted to be disposed into the bore and landed on the seat to restrict fluid flow through the bore and the well conduit. Landing the plug element causes and allowing fluid pressure to build causes the plug element support member to move from the retracted position to the extended position to provide support to the plug element landed on the seat.

22 Claims, 3 Drawing Sheets

U.S. PATENT DOCUMENTS

| | | | |
|---|---|---|---|
| 3,901,315 | A | 8/1975 | Parker et al. |
| 4,160,478 | A | 7/1979 | Calhoun et al. |
| 4,291,722 | A | 9/1981 | Churchman |
| 4,390,065 | A | 6/1983 | Richardson |
| 4,448,216 | A | 5/1984 | Speegle et al. |
| 4,478,279 | A | 10/1984 | Puntar et al. |
| 4,510,994 | A | 4/1985 | Pringle |
| 4,537,383 | A | 8/1985 | Fredd |
| 4,576,234 | A | 3/1986 | Upchurch |
| 4,583,593 | A | 4/1986 | Zunkel et al. |
| 4,669,538 | A | 6/1987 | Szarka |
| 4,826,135 | A | 5/1989 | Mielke |
| 5,056,599 | A | 10/1991 | Comeaux et al. |
| 5,244,044 | A | 9/1993 | Henderson |
| 5,297,580 | A | 3/1994 | Thurman |
| 5,704,393 | A | 1/1998 | Connell et al. |
| 5,762,142 | A | 6/1998 | Connell et al. |
| 5,813,483 | A | 9/1998 | Latham et al. |
| 5,960,881 | A | 10/1999 | Allamon et al. |
| 6,050,340 | A | 4/2000 | Scott |
| 6,155,350 | A | 12/2000 | Melenyzer |
| 6,293,517 | B1 | 9/2001 | Cunningham |
| 6,530,574 | B1 | 3/2003 | Bailey et al. |
| 6,547,007 | B2 | 4/2003 | Szarka et al. |
| 6,634,428 | B2 | 10/2003 | Krauss et al. |
| 6,666,273 | B2 | 12/2003 | Laurel |
| 6,668,933 | B2 | 12/2003 | Kent |
| 6,834,726 | B2 | 12/2004 | Giroux et al. |
| 6,866,100 | B2 | 3/2005 | Gudmestad et al. |
| 6,896,049 | B2 | 5/2005 | Moyes |
| 7,150,326 | B2 | 12/2006 | Bishop et al. |
| 7,503,392 | B2 | 3/2009 | King et al. |
| 2005/0061372 | A1 | 3/2005 | McGrath et al. |
| 2005/0126638 | A1 | 6/2005 | Gilbert |
| 2005/0205264 | A1 | 9/2005 | Starr et al. |
| 2006/0175092 | A1 | 8/2006 | Mashburn |
| 2006/0213670 | A1 | 9/2006 | Bishop et al. |
| 2006/0243455 | A1 | 11/2006 | Telfer et al. |
| 2007/0023087 | A1 | 2/2007 | Krebs et al. |
| 2008/0066924 | A1 | 3/2008 | Xu |
| 2008/0217025 | A1 | 9/2008 | Ruddock et al. |
| 2009/0044948 | A1 | 2/2009 | Avant et al. |
| 2009/0044955 | A1 | 2/2009 | King et al. |

OTHER PUBLICATIONS

International Search Report, Jan. 19, 2009, pp. 1-3, PCT/US2008/072470, Korean Intellectual Property Office.

Written Opinion of the International Searching Authority, Jan. 19, 2009, pp. 1-3, PCT/US2008/072470, Korean Intellectual Property Office.

Notification of Transmittal of the International Search Report and the Written Opinion of the International Searching Authority, Or the Declaration, Feb. 11, 2009, pp. 1-4, PCT/US2008/072732, Korean Intellectual Property Office.

International Search Report, Feb. 11, 2009, pp. 1-3, PCT/US2008/072732, Korean Intellectual Property Office.

Written Opinion of the International Searching Authority, Feb. 11, 2009, pp. 1-3, PCT/US2008/072732, Korean Intellectual Property Office.

Notification of Transmittal of the International Search Report and the Written Opinion of the International Searching Authority, Or the Declaration, Feb. 11, 2009, pp. 1-4, PCT/US2008/072734, Korean Intellectual Property Office.

International Search Report, Feb. 11, 2009, pp. 1-3, PCT/US2008/072734, Korean Intellectual Property Office.

Written Opinion of the International Searching Authority, Feb. 11, 2009, pp. 1-4, PCT/US2008/072734, Korean Intellectual Property Office.

Notification of Transmittal of the International Search Report and the Written Opinion of the International Searching Authority, Or the Declaration, Feb. 11, 2009, pp. 1-4, PCT/US2008/072735, Korean Intellectual Property Office.

International Search Report, Feb. 11, 2009, pp. 1-3, PCT/US2008/072735, Korean Intellectual Property Office.

Written Opinion of the International Searching Authority, Feb. 11, 2009, pp. 1-4, PCT/US2008/072735, Korean Intellectual Property Office.

Office Action dated Jul. 16, 2008 in U.S. Appl. No. 11/891,713 U.S. Patent and Trademark Office, U.S.A.

StageFRAC Maximize Reservoir Drainage, 2007, pp. 1-2, Schlumberger, U.S.A.

Brad Musgrove, Multi-Layer Fracturing Solution Treat and Produce Completions, Nov. 12, 2007, pp. 1-23, Schlumberger, U.S.A.

G.L. Rytlewski, A Study of Fracture Initiation Pressures in Cemented Cased-Hole Wells With out Perforations, May 15, 2006, pp. 1-10, SPE 100572, Society of Petroleum Engineers, U.S.A.

Response to Office Action dated Oct. 15, 2008, in U.S. Appl. No. 11/891,713, U.S. Patent and Trademark Office, U.S.A.

Notice of Allowance & Fees Due and Notice of Allowability dated Jan. 5, 2009, in U.S. Appl. No. 11/891,713, U.S. Patent and Trademark Office, U.S.A.

Office Action dated Jun. 25, 2009, in U.S. Appl. No. 11/891,714, U.S. Patent and Trademark Office, U.S.A.

Office Action dated Jul. 6, 2009, in U.S. Appl. No. 12/317,647, U.S. Patent and Trademark Office, U.S.A.

Office Action dated Jul. 7, 2009, in U.S. Appl. No. 11/891,706, U.S. Patent and Trademark Office, U.S.A.

Summary of Examiner Interview dated Aug. 6, 2009, in U.S. Appl. No. 12/317,647, U.S. Patent and Trademark Office, U.S.A.

Summary of Examiner Interview dated Aug. 7, 2009, in U.S. Appl. No. 11/891,706, U.S. Patent and Trademark Office, U.S.A.

Amendment in Response to Office Action dated Aug. 10, 2009, in U.S. Appl. No. 12/317,647, U.S. Patent and Trademark Office, U.S.A.

Amendment in Response to Office Action dated Aug. 10, 2009, in U.S. Appl. No. 11/891,714, U.S. Patent and Trademark Office, U.S.A.

Amendment in Response to Office Action dated Aug. 10, 2009, in U.S. Appl. No. 11/891,706, U.S. Patent and Trademark Office, U.S.A.

* cited by examiner

BALL SEAT HAVING FLUID ACTIVATED BALL SUPPORT

BACKGROUND

1. Field of Invention

The present invention is directed to ball seats for use in oil and gas wells and, in particular, to ball seats having one or more fluid activated ball support.

2. Description of Art

Ball seats are generally known in the art. For example, typical ball seats have a bore or passageway that is restricted by a seat. The ball or drop plug is disposed on the seat, preventing fluid from flowing through the bore of the ball seat and, thus, isolating the tubing or conduit section in which the ball seat is disposed. As the fluid pressure above the ball or drop plug builds up, the conduit can be pressurized for tubing testing or actuating a tool connected to the ball seat such as setting a packer. Ball seats are also used in cased hole completions, liner hangers, flow diverters, frac systems, and flow control equipment and systems.

Although the terms "ball seat" and "ball" are used herein, it is to be understood that a drop plug or other shaped plugging device or element may be used with the "ball seats" disclosed and discussed herein. For simplicity it is to be understood that the term "ball" includes and encompasses all shapes and sizes of plugs, balls, or drop plugs unless the specific shape or design of the "ball" is expressly discussed.

As mentioned above, all seats allow a ball to land and make a partial or complete seal between the seat and the ball during pressurization. The contact area between the ball and the inner diameter of the seat provides the seal surface. Generally, the total contact area or bearing surface between the ball and the seat is determined by the outer diameter of the ball and the inner diameter of seat. The outer diameter of the contact area is determined by the largest diameter ball that can be transported down the conduit. The inner diameter of the seat is determined by the allowable contact stress the ball can exert against the contact area and/or the required inner diameter to allow preceding passage of plug elements or tools, and/or subsequent passage of tools after the plug element is removed, through the inner diameter of the seat.

The seat is usually made out of a metal that can withstand high contact forces due to its high yield strength. The ball, however, is typically formed out of a plastic material that has limited compressive strength. Further, the contact area between the ball and seat is typically minimized to maximize the seat inner diameter for the preceding passage of balls, plug elements, or other downhole tools. Therefore, as the ball size becomes greater, the contact stresses typically become higher due to the increasing ratio of the cross-section of the ball exposed to pressure compared to the cross-section of the ball in contact with the seat. This higher contact pressure has a propensity to cause the plastic balls to fail due to greater contact stresses.

The amount of contact pressure a particular ball seat can safely endure is a direct function of the ball outer diameter, seat inner diameter, applied tubing pressure, and ball strength. Because of limited ball strength as discussed above, the seat inner diameter is typically reduced to increase the contact area (to decrease contact stress). The reduced seat inner diameter forces the ball previously disposed through the seat inner diameter to have a smaller outer diameter to pass through this seat inner diameter. This reduction in outer diameter of previous balls continues throughout the length of conduit until ball seats can no longer be utilized. Therefore, a string of conduit is limited as to the number of balls (and, thus ball seats) that can be used which reduces the number of actuations that can be performed through a given string of conduit.

SUMMARY OF INVENTION

Broadly, ball seats having a housing, a seat, and a plug element such as a ball are disclosed. In one specific embodiment, one or more actuatable plug element support members are disposed in the housing of the ball seat below the seat. The plug element support members provide support to the ball so that the ball can withstand greater pressures forcing the ball against the seat. The plug element support members are in fluid communication with the bore of the housing such that fluid, e.g., hydraulic fluid, being pumped into the ball seat can actuate the plug element support members causing the plug element support members to move from their retracted positions to their extended positions. The extended positions of the plug element support members result in the plug element support members contacting the ball to provide support to the ball during pressurization of the conduit in which the ball seat is disposed.

In one specific embodiment the ends of plug element support members are flush with the seat inner diameter when in their retracted positions. In another embodiment, the retracted position of the plug element support members is completely within the housing so that "drift" through the ball seat is changed.

Typically, the ball is landed and pressured to a predetermined pressure. Upon pressurization of the conduit so that the ball is pushed into the seat, the plug element support members extend from their retracted positions and into the seat inner diameter to engage with, and provide additional support to, the ball as it is being pressurized. In other words, the same pressure in the tubing used to push the plug element support members inward to the ball seat also forces the plug element support members from their retracted position toward the centerline (or axis) of the ball seat and into their extended positions, thus making contact with the unsupported area of the ball below the seal surface.

By making contact with, or engaging, the ball, the plug element support members provide mechanical support for the ball. Accordingly, the existing seat contact area between the seat and the ball maintains pressure seal, but the resulting force against the ball caused by pressurization of the ball against the seat is spread out between the existing seat contact area and the additional contact area provided by the extended plug element support members. As the pressure is increased, the force on the ball is transferred to both the original seal area of the seat and to the plug element support members. The applied pressure to the plug element support members, therefore, decreases the likelihood that the force on the ball will push the plug element support members back in. Therefore, the resulting contact force is effectively reduced and, thus, the stresses on the ball are likewise reduced.

Due to the plug element support members providing additional support to the ball, the ball seats disclosed herein provide a plugging method where higher pressure can be exerted onto a seat by a lower strength ball without exceeding the ball's bearing or load strength. For example, the pressure ratings for certain seat configuration/ball strength designs may be increased two or more times greater than current low strength balls by including one or more plug element support members. Further, the contact pressure resulting from having additional contact area provided by the plug element support members can be effectively reduced without affecting the sealability of the ball. Thus, more sizes of balls in closer increments can be utilized in various applications such as in frac ball systems. Additionally, many more balls can be used because the seat inner diameter of subsequent seats can be larger due to the seat inner diameter of the seats of each ball seat in the conduit being larger. This allows more balls to go through the conduit because the seat inner diameters are larger throughout the length of conduit.

Thus, additional contact area is provided by the plug element support members that allow a greater pressure to be exerted onto the ball while keeping the original seat inner diameter the same or, alternatively, allow a larger seat inner diameter with the current pressures. The additional contact area also allows the contact pressure resulting from the tubing pressure onto the ball to be distributed to the standard seat contact area between the seat and the ball and the new contact areas between the engagement surfaces of the plug element support members and the ball, i.e., the surfaces of the plug element support members that engage with the ball.

In one specific embodiment, after the ball seat is no longer needed to block or restrict fluid flow through the conduit, outwardly biased members such as belleville springs, also known as belleville washers, or a coiled spring force the plug element support members to return to their retracted position upon release or reduction of the pressure forcing the ball into the seat.

In one embodiment, an apparatus for restricting fluid flow through a well conduit is disclosed. The apparatus comprises a housing having a longitudinal bore and a seat disposed within the bore; a chamber disposed within the housing, the chamber having a plug element support member operatively associated within the chamber, the plug element support member having a retracted position and an extended position; a passageway in fluid communication with the bore and the chamber; and a plug element adapted to be disposed into the bore and landed on the seat to restrict fluid flow through the bore and the well conduit and to cause the plug element support member to move from the retracted position to the extended position thereby providing support to the plug element landed on the seat. The restriction of fluid flow may be complete, i.e., the conduit is closed, or the restriction may only be partial. In other words, fluid may leak around the plug element landed on the seat, as well as past the plug element support member so that plug element does not completely seal off the conduit. The amount of leakage, however, should be low enough so that engagement of the plug element with the seat and plug element support member is sufficient to allow fluid to build up above the plug element until the pressure is sufficiently great to actuate a downhole tool, divert flow at a sufficient pressure to perform whatever function is needed, e.g., frac a well formation, or perform whatever other procedure that is desired.

A further feature of the apparatus is that the chamber may be disposed within the housing below the seat. Another feature of the apparatus is that the passageway may be in fluid communication with the bore above the seat. An additional feature of the apparatus is that the plug element support member may be a ram. Still another feature of the apparatus is that the ram may be a piston having a head portion and a stem portion, the stem portion having an engagement surface. A further feature of the apparatus is that the engagement surface may comprise a shape that is reciprocal to a shape of the plug element. Another feature of the apparatus is that the piston may include at least one outwardly biased member to facilitate movement of the piston from the extended position to the retracted position. An additional feature of the apparatus is that the outwardly biased member may include at least one belleville spring. Still another feature of the apparatus is that the housing may include at least two chambers in fluid communication with a passageway, each of the at least two chambers having a plug element support member operatively disposed therein. A further feature of the apparatus is that the housing may include at least four chambers in fluid communication with a passageway, each of the at least four chambers having a plug element support member operatively disposed therein. Another feature of the apparatus is that the seat may comprise a slidable element and a fixed element having an inner wall operatively associated with the slidable element and the fixed element, the inner wall defining the chamber, and wherein the plug element support element comprises the inner wall.

In another embodiment, an improvement in a ball seat located within a string of conduit in a well is disclosed. The ball seat comprises a housing having a longitudinal bore and a seat, and the improvement comprises at least one chamber in fluid communication with the bore through a passageway, the at least one chamber having a plug element support member, the plug element support member having a retracted position and an extended position wherein the plug element support member provides support to a plug element landed on the seat when the plug element support member is in the extended position.

A further feature of the improved ball seat is that the plug element support member may be a piston. Another feature of the improved ball seat is that the piston may include a head and a stem, the stem having an engagement surface disposed at a lower end of the stem. An additional feature of the improved ball seat is that the engagement surface may have a shape that is reciprocal to a shape of the plug element. Still another feature of the improved ball seat is that the piston may include at least one outwardly biased member to facilitate movement of the piston from the extended position to the retracted position. A further feature of the improved ball seat is that the outwardly biased member may be at least one belleville spring.

In an additional embodiment, a method of actuating a downhole tool disposed in the wellbore of a well is disclosed. The method comprising the steps of: (a) providing a seat disposed within a housing having a longitudinal bore; (b) lowering the housing on a string of conduit into a wellbore of a well; (c) inserting a plug element into the conduit and landing the plug element on the seat to restrict flow through the conduit; and (d) extending a plug element support member from the housing and into the bore of the housing until the plug element support member engages the plug element to provide support to the plug element resulting in the plug element being supported by the seat and the plug element support member to facilitate restriction of fluid flow through the conduit.

A further feature of the method is that the method may further comprise the steps of: (e) pumping a fluid into the conduit to force the plug element into the seat and to extend the plug element support member from the housing and into the bore of the housing until the plug element support member engages the plug element to provide support to the plug element; and (f) actuating a downhole tool by increasing the fluid pressure within the conduit. Another feature of the method is that step (e) may be performed prior to step (d) so that pumping fluid into the conduit extends the plug element support member from the housing and into the bore of the housing until the plug element support member engages the plug element to provide support to the plug element. An additional feature of the method is that the method may further comprise the step of reducing the pressure in the conduit after step (d) thereby causing the plug element support member to retract into the housing. Still another feature of the method is that the fluid may be pumped into the conduit, through a passageway disposed in the housing, and into a chamber having the plug element support member operatively associated therein to force the plug element support member inward from a retracted position to an extended position.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
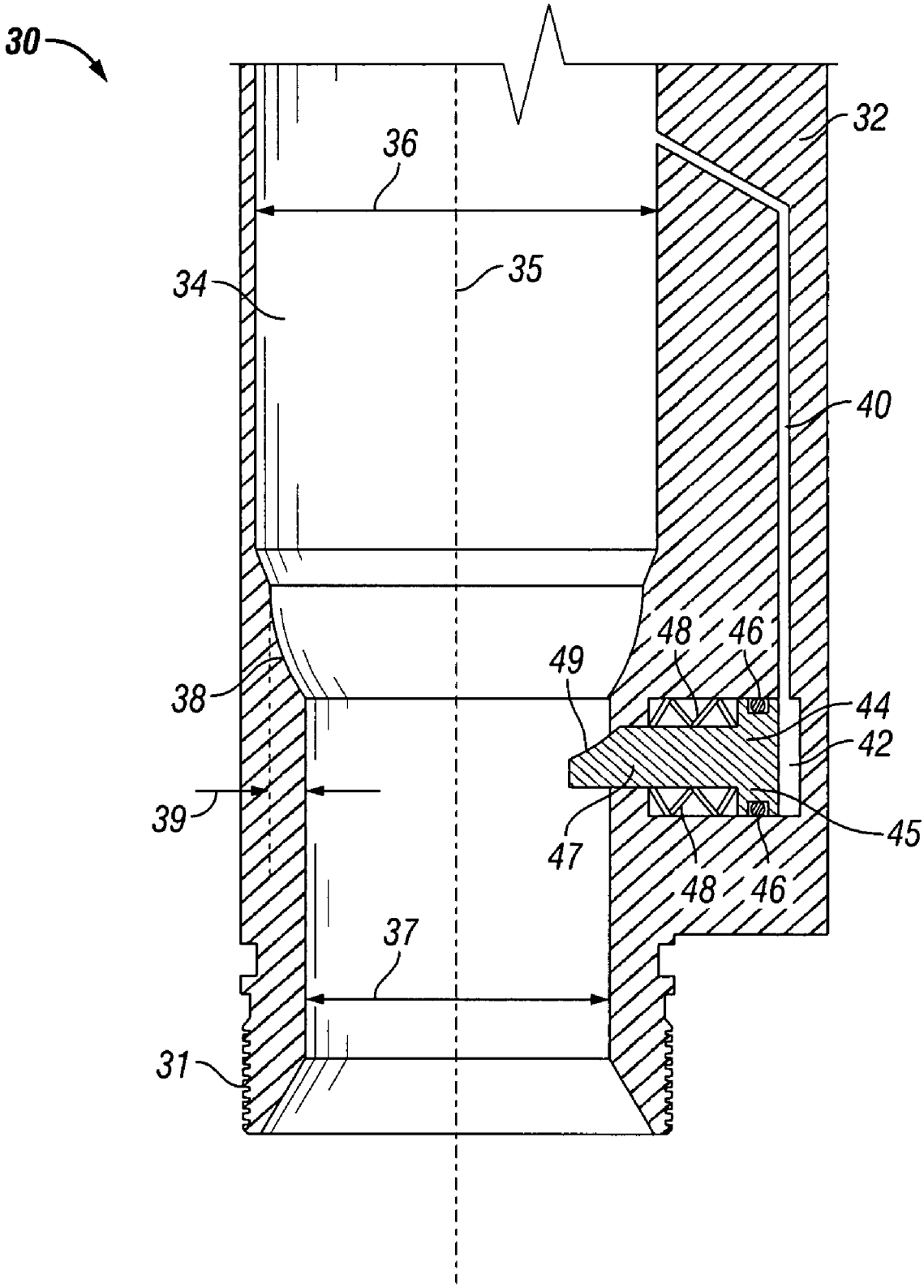
FIG. 1 is a partial cross-sectional view of a specific embodiment of a ball seat disclosed herein shown in the run-in position.
Figure 2:
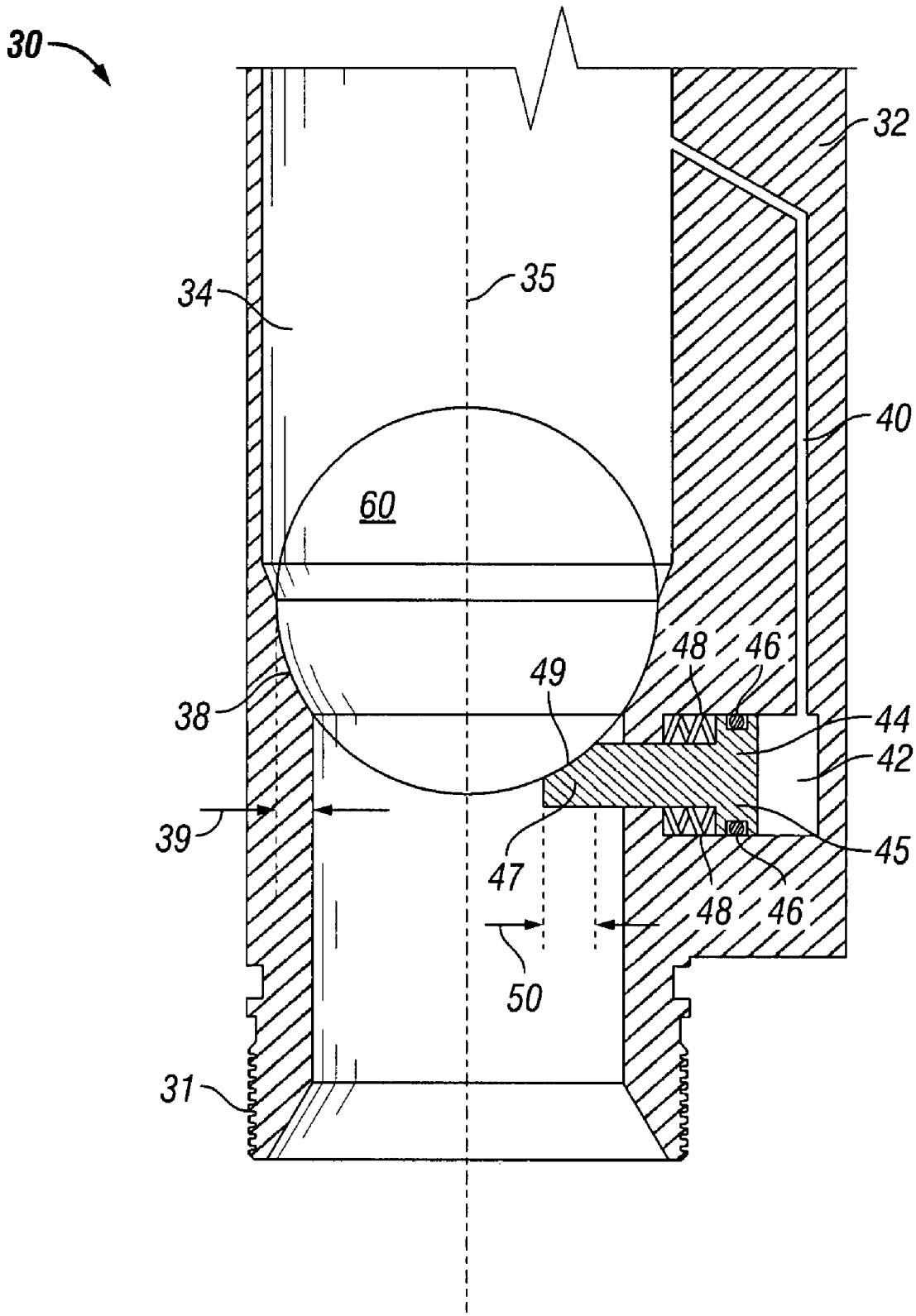
FIG. 2 is a partial cross-sectional view of the ball seat shown in FIG. 1 shown in the actuated or set position.

Referring now to FIGS. 1-2, ball seat 30 includes a sub or housing 32 having bore 34 defined by an inner wall surface and having axis 35. Bore 34 is divided by seat 38 into an upper portion defined by inner diameter 36 and a lower portion defined by inner diameter 37. Inner diameter 36 is also referred to as the "outer diameter of the contact area," and inner diameter 37 is also referred to as the "seat inner diameter" or "inner diameter of the seat." Seat 38 provides contact area 39. Therefore, the outer diameter of contact area 39 is defined by inner diameter 36 and the inner diameter of contact area 39 is defined by inner diameter 37. Attachment members such as threads 31 are disposed along the outer diameter of housing 32 for securing ball seat into a string of conduit, such as drill pipe or tubing. Additional attachment members (not shown) are also included at the opposite end (not shown) of ball seat 30.

Housing 32 includes passage or passageway 40 that fluidly connects bore 34 with chamber 42. Plug element support member 44 is operatively disposed within chamber 42. Plug element support member 44 includes a retracted position (FIG. 1) and a plurality of extended positions, the fully extended position being shown in FIG. 2 in which plug element support member 42 engages plug element 60. Plug element support member 44 may be a ram, or as shown in the embodiment of FIGS. 1-2, a piston 45.

Piston 45 is slidingly engaged within chamber 42. Seals 46 create a fluid tight seal between the outer side of the head of piston 45 and the inner side of the head of piston 45. Piston 45 also includes stem 47 connected to the head of piston 45. The lower end of stem 47 is shaped to form an engagement surface 49 that is reciprocal in shape to the shape of the plug element 60 (shown in FIG. 2 as a ball). Outwardly biased members 48, shown as belleville springs (and also known as "belleville washers"), are disposed against the inner side of piston 45. In another embodiment, outwardly biased member 48 may be a coil spring (not shown) that urges piston 45 outward. In the embodiment shown in FIGS. 1-2, piston stem 47 and, thus, engagement surface 49, protrude slightly into bore 34 when piston 45 is in its retracted or "run-in" position, i.e., before the ball or plug is seated in ball seat 30. It is to be understood, however, that piston stem 47 and engagement surface 49 may be completely retracted into chamber 42 in the "run-in" position.

With particular reference to FIG. 2, ball seat 30 is operated by disposing plug element 60 within bore 34 so that plug element 60 is seated on seat 38. As mentioned above, although plug element 60 is shown as a ball in FIG. 2, it is to be understood that plug element 60 may be a drop plug or any other plug element known to persons of ordinary skill in the art.

After plug element 60 is seated against seat 38, wellbore fluid pressure builds up in bore 34 and through passageway 40. As a result, wellbore fluid pressure presses against the outer side of piston 45 urging piston 45 inward against belleville springs 48, causing belleville spring 48 to be compressed between the inner surface of piston 45 and a retainer defined by an inner wall of chamber 42. Therefore, piston stem 47 is forced inwardly through a chamber passage fluidly connecting chamber 42 with bore 34. Thus, piston stem 47 is forced into bore 34 until engagement surface 49 contacts plug element 60.

Initially, the only contact area for plug element 60 with seat 38 is contact area 39. However, once plug element 60 is seated on seat 38, pressure, such as from hydraulic fluid (not shown), builds up, in this case above plug element 60, until the hydraulic fluid flows into passageway 40 and into chamber 42 with sufficient force to push plug element support member 44, e.g., piston 45, into bore 34. As the pressure of the hydraulic fluid increases, plug element support member 44 is pushed further into bore 34 until engagement surface 49 of stem 47 engages with plug element 60. As shown in this embodiment, plug element 60 is a spherical ball and engagement surface 49 has an arc shape that is reciprocal to the outer diameter of the ball. As a result, plug element 60 is now in contact with, and supported by, contact area 39 plus contact area 50. Thus, the amount of support of plug element 60 is increased from contact area 39 to contact area 50 and contact area 39. Further, after engagement, the hydraulic fluid pressure acting on plug element support member 44, in this case, the outer surface of piston 45, approaches equalization with the downward pressure acting on plug element 60 further providing support to plug element 60.

After increased fluid pressure is no longer needed, e.g., a downhole tool such as a packer has been set or actuated by the increased fluid pressure caused by the blocking of bore 34, fluid pressure is reduced and piston 45 is urged outward by belleville springs 48 until engagement surface 49 is no longer in contact with plug element 60 and ultimately is returned to the retracted position. Subsequently, plug element 60 can be removed through methods and using devices known to persons of ordinary skill in the art, e.g., milling, dissolving, or fragmenting plug element 60 or by forcing plug element 60 through seat 38 using force that is sufficient to force plug element 60 through seat 38, but insufficient to move plug element support member 44 from the retracted position to the extended position. Alternatively, plug element 60 may be a lightweight "float" plug element such that, when pressure is reduced, plug element 60 is permitted to float up to the top of the well.

In one embodiment of the operation of ball seat 30, ball seat 30 is placed in a string (not shown) with a downhole tool (not shown), such as a packer or a bridge plug located above. The string is run into the wellbore to the desired location. Plug element 60 is dropped down the string, into bore 34 of housing 32, and landed on seat 38. Alternatively, plug element 60 may be placed in housing 32 before running. The operator pumps fluid into the string. Plug element 60 forms a seal against the seat 38 because the reciprocal shape of seat 38 with the shape of plug element 60. Fluid (not shown) builds up above plug element 60 until the pressure is sufficiently great to force plug element support member 44 from chamber 42 into engagement with plug element 60. Due to the additional contact area 50 between plug element 60 and engagement surface 49, higher fluid pressures can be exerted on plug element 60 to ultimately actuate the downhole tool.

After the downhole tool is actuated, it is desirable to remove plug element 60 from seat 30 so fluid can flow through the string. In one embodiment, removal of plug element 60 can be accomplished by decreasing the wellbore fluid pressure such that plug element support member 44 is forced outwardly by belleville springs 48. The reduction in contact area on plug element 60 allows plug element 60 to be released from seat 38 such as by forcing ball through seat 39 defined by inner diameter 37 by pressure sufficient to move plug element 60, but insufficient to move plug element support member 44 inward from the retracted position to the extended position.

It is to be understood that although ball seat 30 is shown in FIGS. 1-2 as having a single chamber 42 with a single plug element support member 44 operatively disposed therein, it is to be understood that ball seat 30 may include two, three, four, or more chambers 42, each having a plug element support member 44 operatively disposed therein and each chamber 42 having a passageway 40 in fluid communication with the bore 34. In the embodiment in which two chambers 42 are included, the two chambers 42 can be disposed opposite each other, i.e., 180 degrees from each other. In the embodiment in which four chambers 42 are included, the three chambers 42 can be disposed 120 degrees from each other. In the embodiment in which four chambers 42 can be included, the four chambers 42 are disposed 90 degrees from each other.

Further, in another embodiment, a single chamber 42 may be disposed circumferentially around bore 34 and plug support member 44 may be a c-ring (not shown) operatively disposed within the single chamber 42. Also, stem 47 of piston 45 may be eccentrically offset with the head of piston 45 to facilitate alignment of plug support member 44 with plug element 60.

Figure 3:
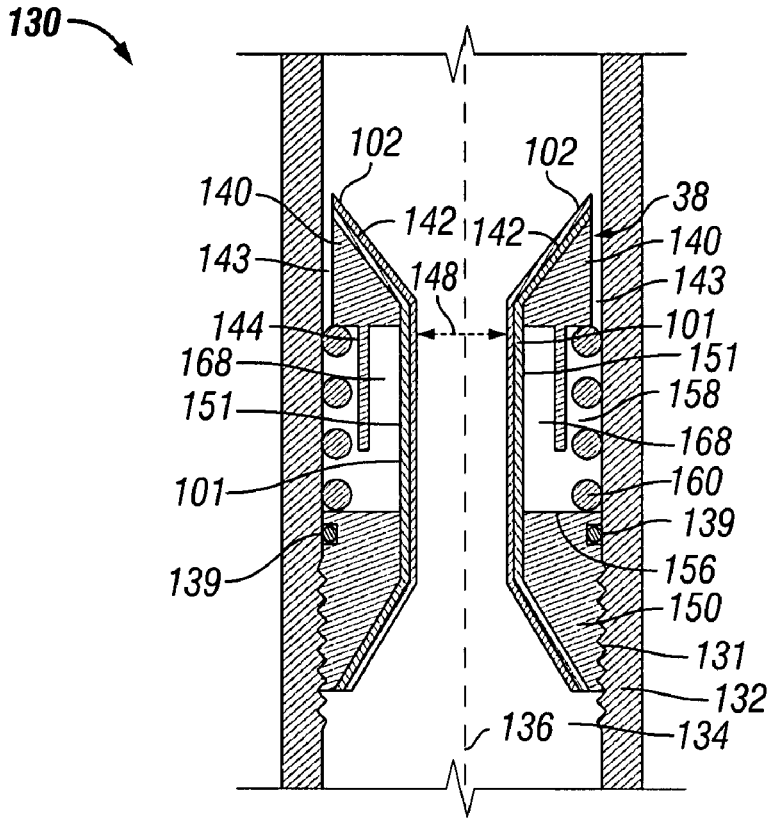
FIG. 3 is a partial cross-sectional view of a specific embodiment of a ball seat disclosed herein shown in the run-in position.
Figure 4:
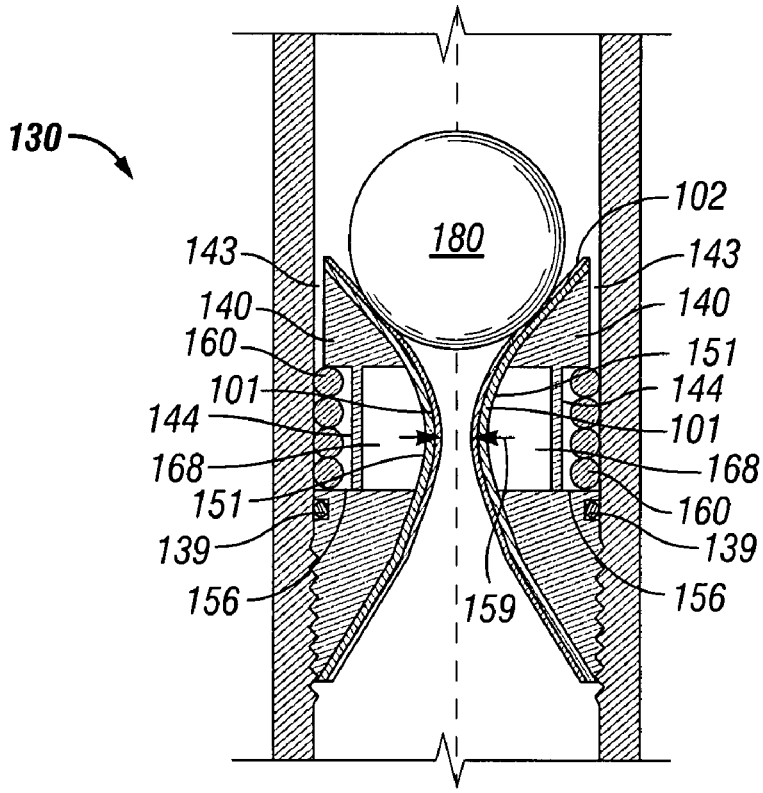
FIG. 4 is a partial cross-sectional view of the ball seat shown in FIG. 1 shown in the actuated or set position.

Referring now to FIGS. 3-4, in another embodiment, ball seat 130 includes a sub or housing 132 having bore 134 defined by an inner wall surface and having axis 136. Attachment members such as threads (not shown) can be disposed along the outer diameter of housing 132 or along the inner wall surface of bore 134 at the upper and lower ends of housing 132 for securing ball seat 130 into a string of conduit, such as drill pipe or tubing.

Bore 134 includes seat 138 for receiving plug element 180, shown as a ball in FIG. 4. Seat 138 includes slidable element 140 and fixed element 150. Slidable element 140 includes a housing engagement surface in sliding engagement with the inner wall surface of housing 132 (also referred to herein as a seat engagement surface) so that slidable element 140, and thus, seat 138, has a first position (FIG. 3) and a second position (FIG. 4).

Slidable element 140 also includes plug element engagement surface 142 for receiving plug element 180. Plug element engagement surface 142 can be shaped to form an engagement surface with plug element 180 that is reciprocal in shape to the shape of the plug element 180 (shown in FIG. 4 as a ball). Thus, in this embodiment, plug element 180 is spherically-shaped and plug element engagement surface 142 includes an arc shape (not shown). As mentioned above, however, although plug element 180 is shown as a ball in FIG. 4, it is to be understood that plug element 180 may be a drop plug, dart, or any other plug element known to persons of ordinary skill in the art. Slidable element 140 further includes stop member 144 to restrict downward movement of slidable element 140.

Fixed element 150 is secured to the inner wall surface of bore 134 by attachment members such as through threads 131 and includes seals 139 to reduce the likelihood of fluid leaks between fixed element 150 and the inner wall surface of housing 132. Fixed element 150 also includes retainer wall surface 156 for engaging with stop member 144 of slidable element 140.

Inner wall 101 defines a seat bore having a seat inner diameter. A portion of the seat inner diameter defined by inner wall 101 is variable. Thus, in the run-in position (FIG. 3), this portion of the seat inner diameter is referred to as the first seat inner diameter 148 and, in the set-position (FIG. 4), this portion of the seat inner diameter is referred to as the second seat inner diameter 159 (FIG. 4). First seat inner diameter 148 is greater than second seat inner diameter 159. Thus, inner wall 101 functions as plug element support member 151 when in the set position (FIG. 4).

Inner wall 101 is in sliding engagement with slidable element 140 and is affixed to slidable element 140 at the uppermost end of slidable element 140. Inner wall 101 is affixed to fixed element 150 at the lowermost end of fixed element 140. Inner wall 101 may be a single element or may be formed by a plurality of ribs. The material for forming inner wall 101 may be formed of any material capable of bending inwardly as described above. Suitable materials for inner wall 101 include steel, annealed steel, spring steel, aluminum, and copper.

Inner wall 101 defines a variable portion of the seat inner diameter such that lateral extension or expansion of inner wall 101, such as by compression, causes inner wall 101 of seat 138 to extend inwardly toward axis 136 as slidable element 140 moves from the run-in position (FIG. 3) to the set position (FIG. 4). Due to inner wall 101 being expanded laterally, a portion of the seat inner diameter is reduced from the first seat inner diameter 48 to the second seat inner diameter 159.

Inner wall 101 and stop member 144 form chamber 168 in fluid communication with bore 134 through passageway 143. Thus, as fluid pressure builds above plug element 180 when seat 138 is in the run-in position (FIG. 4), fluid flows through passageway 143 and into chamber 168. The fluid pressure in chamber 168 acts on inner wall 101 to assist movement, or lateral expansion, of inner wall 101 from the run-in position (FIG. 3) to the set position (FIG. 4). The fluid in chamber 168 also provides additional strength and, thus, support to inner wall 101 so that inner wall 101 can further support plug element 180 (FIG. 4).

Inner wall 101 and stop member 144 also form chamber 158. Return member 160 which is shown in FIGS. 3-4 as an upwardly biased coiled spring, is disposed within chamber 158. Although return member 160 is shown as an upwardly biased coiled spring, return member 160 may be one or more elastomer or rubber element, belleville spring (also known as belleville washers), or any other return device, element, or member known to persons of ordinary skill in the art. Return member 160 facilitates movement of slidable element 140 and, thus, seat 138 from its set position (FIG. 4) back toward the run-in position (FIG. 3) when plug element 180 is no longer being forced into seat 138.

In one embodiment, layer 102 is disposed on plug element engagement surface 142 and along inner wall 101. Layer 102 is affixed to inner wall 101 at the uppermost and lowermost ends of inner wall 101 so that layer 102 can expand inwardly with inner wall 101 as discussed in greater detail above.

Layer 102 may be a rubber or polymer or elastomer coating layer to facilitate plug element 170 engaging with seat 138. Alternatively, layer 102 may be a non-slip coating applied to plug element engagement surface 142. In the embodiment shown in FIGS. 3-4, layer 102 is an elastomer or polymer that facilitates creation of a sealing engagement between plug element engagement surface 142 and plug element 180 (FIG. 4). Layer 102 may also create a sealing engagement between plug element support members 151 when in the set position (FIG. 4).

In the embodiments in which plug element engagement surface 142 includes layer 102, layer 102 may include a shape reciprocal to the shape of the plug element when seat 138 is in the set position. As shown in FIG. 4, plug element 180 is a ball having a spherical shape and layer 102 is deformed to have a reciprocal arc shape. As mentioned above, however, although plug element 180 is shown as a ball in FIG. 4, it is to be understood that plug element 180 may be a drop plug, dart, or any other plug element known to persons of ordinary skill in the art.

In another particular embodiment, chamber 168 includes a deformable element (not shown) disposed therein. The deformable element may be formed, in whole or in part, from one or more elastomer, polymer, or other deformable material that will change shape as slidable element 140 moves from the run-in position (FIG. 3) to the set position (FIG. 4) and extend laterally, e.g., inwardly into the seat bore to reduce the seat inner diameter from first seat inner diameter 148 to second seat inner diameter 159. In other words, deformable element, in combination with fluid flowing through passageway 143 and into chamber 168, assists lateral movement of inner wall 101 and provides additional support to inner wall 101 when seat 138 is in the set position.

Suitable deformable materials include, but are not limited to nitrile, carboxylated nitrile, hydrogenated nitrile butyl rubber, AFLAS® fluoropolymers and fluoroelastomers such as those available from AGC Chemicals America, Inc. located in Bayonne, N.J., EPDM, and viton.

Although the embodiment shown in FIGS. 3-4 includes layer 102, it is to be understood that layer 102 is not required. Moreover, ball seat 130 can have slidable element 140 and fixed element 150 as an integral, or whole, structure. In other words, slidable element 140 and fixed element 150 are a single structure connected by inner wall 101. Further, layer 102 may engage one another and, in one particular embodiment, compress into one another, so that second seat inner diameter 159 has a measurement of 0.

Similarly to the embodiment discussed above with respect to FIGS. 1-2, fluid alone or together with a deformable element provides additional support to plug element 180 due to plug element support member 151, i.e., inner wall 101, being extended or expanded laterally, e.g., inwardly toward axis 136 so that the force acting upon plug element 180 is distributed through a larger area. Additionally, ball seat 130 includes a return member 160 that is energized when slidable element 140 is moved from the run-in position (FIG. 3) to the set position (FIG. 4). Accordingly, when the pressure forcing plug element 180 into plug element engagement surface 142 dissipates, return member 160 forces slidable element 140 from the set position toward the run-in position. As a result, the portion of the seat inner diameter defined by inner wall 101 is returned toward the first seat inner diameter 148.

Referring now with particular reference to FIG. 4, plug element 180 is disposed on seat 138 by engaging plug element 180 with plug element engagement surface 142. As fluid pressure is exerted downward onto plug element 180, fluid flows through passageway 143 and into chamber 168. As the fluid pressure above plug element 180 increases, slidable element 140 is forced downward, compressing return member 160 against retainer wall surface 156 until stop member 144 contacts retainer wall surface 156. As slidable element 140 moves downward, inner wall 101 is forced inward toward axis 136. Due to inner wall 101 being forced inward, the seat inner diameter decreases from first seat inner diameter 148 (FIG. 3) to second seat inner diameter 159 (FIG. 4), thereby providing greater support to plug element 180. As shown in FIG. 4, inner wall 101 is not required to contact plug element 180; however, as pressure above plug element 180 increases, plug element 180 may begin to deform and be extruded through seat inner diameter 159. As plug element 180 deforms and is extruded through seat inner diameter 159, plug element 180 may contact with, and be additionally supported by, inner wall 101. Alternatively, inner wall 101 may completely close off bore 134, i.e., second inner diameter 159 is eliminated, or bore 134 may have a measurable second inner diameter 159 as shown in FIG. 4).

After the pressure forcing plug element 180 into plug element engagement surface 142 dissipates, such as after a downhole tool is actuated by the pressurization of the fluid above plug element 180, the energized return member 160 forces slidable element 140 from the set position to the run-in position. As a result, fluid is forced out of chamber 168, through passageway 143, and into bore 134 and the portion of the seat inner diameter defined by inner wall 101 is returned from the second seat inner diameter 159 toward the first seat inner diameter 148. Plug element 180 may be retrieved or removed through the same methods as described above with respect to FIGS. 1-2.

Although the apparatus described in greater detail with respect to FIGS. 1-4 is ball seat 30, 130 having a ball as plug element 60, it is to be understood that the apparatuses disclosed herein may be any type of seat known to persons of ordinary skill in the art that include at least one plug element support member 44, 151. For example, the apparatus may be a drop plug seat, wherein the drop plug temporarily blocks the flow of fluid through the wellbore. Therefore, the term "plug" as used herein encompasses a ball as shown in FIGS. 2 and 4, as well as any other type of device that is used to temporary block the flow of fluid through ball seat 30, 130.

Further, in the embodiments discussed herein with respect FIGS. 1-4, upward, toward the surface of the well (not shown), is toward the top of FIGS. 1-4, and downward or downhole (the direction going away from the surface of the well) is toward the bottom of FIGS. 1-4. However, it is to be understood that ball seats 30, 130 may have their positions rotated. Accordingly, ball seats 30, 130 can be used in any number of orientations easily determinable and adaptable by persons of ordinary skill in the art.

It is to be understood that the invention is not limited to the exact details of construction, operation, exact materials, or embodiments shown and described, as modifications and equivalents will be apparent to one skilled in the art. For example, the size of each plug element support member can be any size or shape desired or necessary to be actuated from the retracted position to the extended position to provide support to the plug element. Alternatively, passageway 40 may be any length or size (by volume) to cause the plug element support member to move to the extended position at predetermined pressures. Moreover, passageway 40 may be angled downward or upward (as shown in FIGS. 1-2) to further allow customization as to the pressure needed to move the plug element support member from the retracted position to the extended position. Further, the ball may be any plug element known to persons of ordinary skill in the art. Examples include darts and drop plugs. Accordingly, the invention is therefore to be limited only by the scope of the appended claims.

What is claimed is:

1. An apparatus for restricting fluid flow through a well conduit, the apparatus comprising:

a housing having a longitudinal bore and a seat disposed within the bore;

a chamber having a plug element support member operatively associated with the chamber, the plug element support member having a retracted position and an extended position;

a passageway in fluid communication with the bore and the chamber; and a plug element adapted to be disposed into the bore and landed on the seat to restrict fluid flow through the bore and the well conduit thereby forcing fluid through the passageway and into the chamber to cause the plug element support member to move from the retracted position to the extended position to provide support to the plug element landed on the seat.

2. The apparatus of claim 1, wherein the chamber is disposed within the housing below the seat.

3. The apparatus of claim 2, wherein the passageway is in fluid communication with the bore above the seat.

4. The apparatus of claim 1, wherein the plug element support member is a ram.

5. The apparatus of claim 4, wherein the ram is a piston having a head portion and a stem portion, the stem portion having an engagement surface.

6. The apparatus of claim 5, wherein the engagement surface comprises a shape that is reciprocal to a shape of the plug element.

7. The apparatus of claim 6, wherein the piston includes at least one outwardly biased member to facilitate movement of the piston from the extended position to the retracted position.

8. The apparatus of claim 7, wherein the outwardly biased member includes at least one belleville spring.

9. The apparatus of claim 1, wherein the housing includes at least two chambers in fluid communication with a passageway, each of the at least two chambers having a plug element support member operatively disposed therein.

10. The apparatus of claim 1, wherein the housing includes at least four chambers in fluid communication with a passageway, each of the at least four chambers having a plug element support member operatively disposed therein.

11. The apparatus of claim 1, wherein the seat comprises a slidable element and a fixed element having an inner wall operatively associated with the slidable element and the fixed element, the inner wall defining the chamber, and wherein the plug element support element comprises the inner wall.

12. An improvement in a ball seat located within a string of conduit in a well, the ball seat comprising a housing having a longitudinal bore and a seat, the improvement comprising:

at least one chamber in fluid communication with the bore through a passageway, the at least one chamber having a plug element support member, the plug element support member having a retracted position and an extended position wherein the plug element support member is at least partially disposed within the longitudinal bore to provide support to a plug element landed on the seat when the plug element support member is in the extended position and is disposed outside of the longitudinal bore when the plug element support member is in the retracted position.

13. The improved ball seat of claim 12, wherein the plug element support member is a piston.

14. The improved ball seat of claim 13, wherein the piston includes a head and a stem, the stem having an engagement surface disposed at a lower end of the stem.

15. The improved ball seat of claim 14, wherein the engagement surface has a shape that is reciprocal to a shape of the plug element.

16. The improved ball seat of claim 13, wherein the piston includes at least one outwardly biased member to facilitate movement of the piston from the extended position to the retracted position.

17. The improved ball seat of claim 16, wherein the outwardly biased member is at least one belleville spring.

18. A method of restricting fluid flow through a conduit disposed in the wellbore of a well, the method comprising the steps of:

(a) providing a seat disposed within a housing having a longitudinal bore;

(b) lowering the housing on a string of conduit into a wellbore of a well;

(c) inserting a plug element into the conduit and landing the plug element on the seat to restrict flow through the conduit; and (d) extending a plug element support member from the housing and into the bore of the housing until the plug element support member engages the plug element to provide support to the plug element resulting in the plug element being supported by the seat and the plug element support member to facilitate restriction of fluid flow through the conduit.

19. The method of claim 18, further comprising the steps of:

(e) pumping a fluid into the conduit to force the plug element into the seat and to extend the plug element support member from the housing and into the bore of the housing until the plug element support member engages the plug element to provide support to the plug element; and (f) actuating a downhole tool by increasing the fluid pressure within the conduit.

20. The method of claim 19, wherein step (e) is performed prior to step (d) so that pumping fluid into the conduit extends the plug element support member from the housing and into the bore of the housing until the plug element support member engages the plug element to provide support to the plug element.

21. The method of claim 19, wherein the fluid is pumped into the conduit, through a passageway disposed in the housing, and into a chamber having the plug element support member operatively associated therein to force the plug element support member inward from a retracted position to an extended position.

22. The method of claim 18, further comprising the step of reducing the pressure in the conduit after step (d) thereby causing the plug element support member to retract into the housing.

* * * * *